US008356930B2

(12) United States Patent
Capt

(10) Patent No.: US 8,356,930 B2
(45) Date of Patent: Jan. 22, 2013

(54) DYNAMOMETRIC DEVICE FOR INDICATING THE REMAINING BARREL TORQUE IN A TIMEPIECE

(75) Inventor: Edmond Capt, Le Brassus (CH)

(73) Assignee: Blancpain S.A., Le Brassus (CH)

( * ) Notice: Subject to any disclaimer, the term of this patent is extended or adjusted under 35 U.S.C. 154(b) by 206 days.

(21) Appl. No.: 12/979,131

(22) Filed: Dec. 27, 2010

(65) Prior Publication Data

US 2011/0158055 A1 Jun. 30, 2011

(30) Foreign Application Priority Data

Dec. 28, 2009 (EP) ..... 09180823

(51) Int. Cl.
*G04B 9/00* (2006.01)
*G04B 13/00* (2006.01)

(52) U.S. Cl. ..... 368/147; 368/212

(58) Field of Classification Search ..... 368/139–143, 368/145, 147–151, 154, 206–212
See application file for complete search history.

(56) References Cited

U.S. PATENT DOCUMENTS 97,186 A * 11/1869 Gardner ..... 368/212
904,332 A * 11/1908 Kahan ..... 368/212
2,443,558 A * 6/1948 Frennesen ..... 185/44
4,015,421 A * 4/1977 Murrle ..... 368/143
7,490,977 B2 * 2/2009 Zaugg ..... 368/210
7,614,784 B2 * 11/2009 Watanabe ..... 368/210
7,857,502 B2 * 12/2010 Rochat ..... 368/212

FOREIGN PATENT DOCUMENTS

| | | | |
|---|---|---|---|
| CH | 237432 | A | 4/1945 |
| DE | 181980 | C | 6/1905 |
| DE | 20 2008 000 035 | U1 | 7/2008 |
| EP | 1 136 892 | A1 | 9/2001 |

* cited by examiner

*Primary Examiner* — Vit W Miska
(74) *Attorney, Agent, or Firm* — Sughrue Mion, PLLC

(57) ABSTRACT

The invention concerns a dynamometric device (100) indicating the remaining barrel torque in a timepiece including a barrel ratchet (2) cooperating with a ratchet click (3) to keep accumulated, in a mainspring, the energy transmitted by a winding crown, said click (3) which pivots about a pin (10) between a meshed position where a tooth (31) of the ratchet click (3) cooperates with said ratchet (2), and a disengaged position where each tooth (31) of said click (3) withdraws when the ratchet (2) rotates as said barrel is being wound, said click (3) being returned to said ratchet (2) under the action of a spring (4).

The invention is characterized in that it includes a strip spring (1) with a resilient arm (8) fixed to the plate, and in that said pin (10) is mounted on a support (12) of said arm (8), at one end of which it has a hand (6) displaying the barrel torque reserve, in cooperation with a torque reserve indicator (5).

8 Claims, 2 Drawing Sheets

DYNAMOMETRIC DEVICE FOR INDICATING THE REMAINING BARREL TORQUE IN A TIMEPIECE

This application claims priority from European Patent Application No. 09180823.8 filed Dec. 28, 2009, the entire disclosure of which is incorporated herein by reference.

The invention concerns the field of timepiece mechanisms driven by one or more springs wound by a winding crown or automatic winding rotor, or suchlike.

More specifically, the invention concerns a dynamometric device for indicating the remaining barrel torque in a timepiece, which includes a plate, a barrel, and a barrel ratchet arranged for cooperating with a ratchet click to keep accumulated, in a spring comprised in said barrel, the mechanical energy stored by said barrel. Said ratchet click is able to pivot about a click pivot pin, between a meshing position in which at least one tooth of said click cooperates with said ratchet, and a disengaged position in which each tooth of said click withdraws when the ratchet rotates as said barrel is being wound. Said ratchet click is returned towards said ratchet under the action of a ratchet click spring.

A balance spring, particularly a mainspring, is a mechanical member whose response is not linear with time. The torque curve given as a function of the number of turns of the spring is a hysteresis curve between the winding and unwinding curves, whose variations are abrupt at the end of winding and the end of unwinding, but closer to a linear response in an intermediate range, one or two turns away from the end of winding, or respectively the end of unwinding. It is thus useful for the user to be aware both of the remaining torque in the mainspring(s) comprised in his mechanism, and also the optimum zone, which is the aforementioned intermediate range, in which the operation of the timepiece mechanism is at its most regular and most accurate. Of course, the user should be alerted to prevent excessive winding that could damage a spring at the end of winding.

Estimating the power reserve is an old concern. A mechanism including a wheel corresponding to the theoretical duration of run is known from FR Patent No. 321 499 or similarly from U.S. Pat. No. 623,158. This wheel includes a pin at one point on the circumference thereof, which corresponds to the threshold selected for displaying a winding signal using rod linkage. Similar devices are known from FR Patent No. 382 836, DE Patent No. 109 388 or DE Patent No. 319478.

Other devices, such as those known from FR Patent No. 942 026, DE Patent No. 132 789 or DE Patent No. G 77 11 670.2 trigger the appearance of a mechanical signal that depends upon the outer spiral of the mainspring reaching a given position. DE Patent No. 14 02 862 also discloses driving via the mainspring after a theoretical period of unwinding.

These devices, based on the theoretical proper operation of the timepiece mechanism and its mainspring, are insufficient, since they do not take account of any possible letting down of the mainspring or dirt in the gear train, or any phenomenon capable of altering the working of the mechanism.

DE Patent No. 225 092 discloses an improved indicator mounted on an arm that pivots about a pivot pin integral with the plate, this pivoting arm carrying the ratchet click arbour. The pivoting arm includes a nose driven by a tooth which is driven in rotation by the barrel drum.

It thus appeared preferable to concentrate, not on a theoretical position of a spring or wheel, or any other similar device counting down a theoretically passed time, but on the actual torque reserve of the mainspring, which is sufficient to drive the timepiece mechanism, both during the required period, and especially with a sufficient level of precision. It is known that the areas at the end of winding, like the areas at the end of unwinding, of the mainspring are areas to be avoided, because of over-stressing the mechanism in the first case and insufficient precision in both cases.

DE Patent No 181 980 proposed an innovative solution to this problem, by introducing a compensation spring into the mechanism. The barrel ratchet cooperates, in a known manner, with a click mounted on a click support. The latter is pivotally mounted about a pivot pin which is added to the plate of the movement. A helical compensation spring is fixed, both to the plate, and to the click support, which carries an indicator or which is directly connected to an indicator. When the mainspring is being wound, the compensation spring is taut under the effect of pressure from the mainspring, and thus the ratchet, on the click. The click thus subjects the click support, which carries one end of the compensation spring, to a pivoting torque about the pivot pin thereof. When the mainspring is unwinding, the pressure of the ratchet on the click decreases, which gradually lets down the compensation spring, as far as a winding alarm position, displayed by the indicator. This device constitutes distinct progress compared to embodiments of the prior art, but has been little used, because of the weakness of the helical compensation spring and the absence of repeatability thereof.

It is clear that some devices thus exist that are capable of supplying a proper indication of the power reserve, or, rather, the torque reserve of the mainspring. However, some interfere with the working of sensitive members, for example those including a hand connected to the escape spring. Generally, all of the known devices are complex, and incorporate numerous additional components, sometimes with a high unit cost, and requiring time-consuming, painstaking assembly. And, above all, they take up a significant volume which, consequently, is not available for other complications, which limits the possibilities and performance of the timepiece.

In short, it is an object of the invention to propose a simple, compact device, with a greatly reduced number of components, providing the user with a highly reliable indication of the torque reserve available in the mainspring. The reliability of the components must be at least equal to that of the other components of the timepiece, and their presence must not weaken any of said other components.

The invention therefore concerns a dynamometric mainspring torque reserve indicator device for a timepiece as defined in claim 1.

Other features and advantages of the invention will appear more clearly upon reading the following description, with reference to the annexed drawings, in which.

Figure 1:
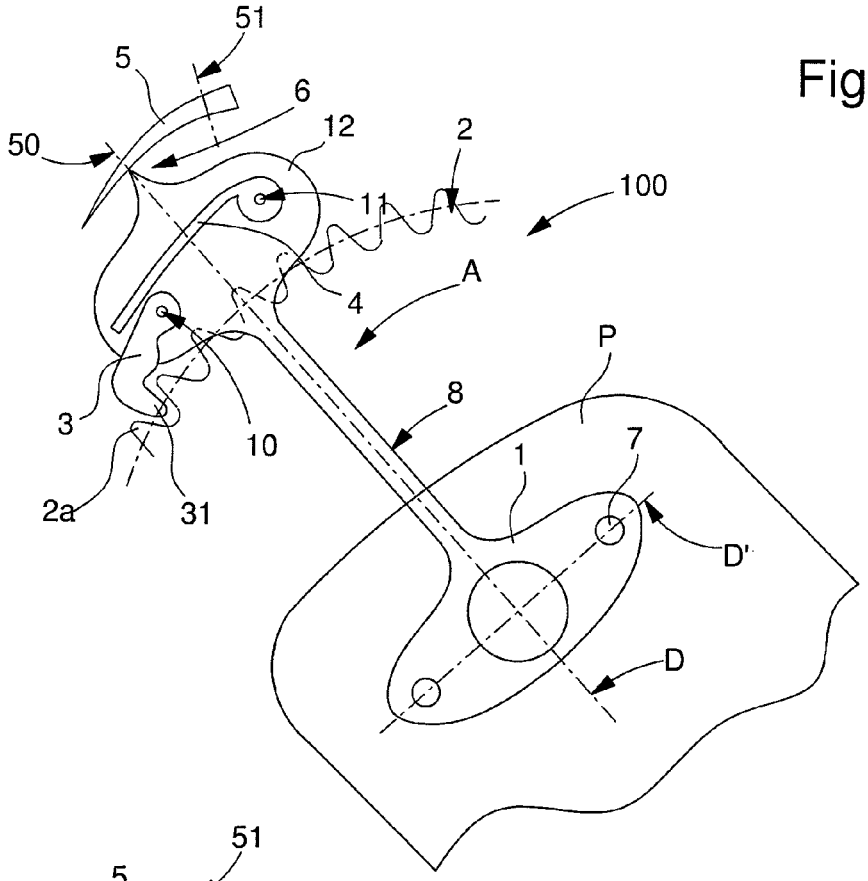
FIG. 1 is a schematic, partial, plan view, relative to a partially shown timepiece mechanism, of an indicator device according to the invention in an unwinding position.

The invention concerns the field of timepiece mechanisms driven by one or more springs wound by a winding crown or an automatic winding rotor, or suchlike.

The invention concerns more specifically a dynamometric device 100, devised as a barrel torque reserve indicator for a timepiece. This timepiece, not shown in detail in the Figures, includes, in a known manner, at least one plate P, at least one barrel, and at least one barrel ratchet 2. The barrel ratchet 2 is arranged for cooperating via its teeth 2*a* with a ratchet click 3 to keep accumulated, in a mainspring in the barrel, the mechanical energy transmitted to the mainspring when it is wound. The mainspring is conventionally tightened or wound by a winding crown and/or by at least one winding rotor in the case of an automatically wound movement. The ratchet click 3 is pivotally mounted about a click pivot pin 10, fixed to a support 12. Click 3 is mobile between a meshed position, and a disengaged position. The meshed position of click 3 is that in which at least one tooth 31 of ratchet click 3, at an end opposite said click pivot pin 10, cooperates with one of the teeth 2*a* of barrel ratchet 2 to immobilise it in the unwinding direction. The disengaged position of click 3 is that in which each tooth 31 of ratchet click 3 withdraws from toothing 2*a* and allows barrel ratchet 2 to rotate when the barrel is being wound. Ratchet click 3 is permanently returned towards barrel ratchet 2 under the action of a ratchet click spring 4. This ratchet click spring 4 is preferably a flat strip spring, including a first end 11 that is stationary relative to a support, and a second free end on the opposite side. Preferably, a stop member (not shown) limits the travel of ratchet click 3 against barrel ratchet 2, and a stop member (also not shown) limits the travel of the free end of ratchet click spring 4 by barrel ratchet 2. Advantageously, these stop members are merged and formed by a single component secured to support 12.

According to the invention, the dynamometric device 100 includes a strip spring 1, a first end of which is rigidly secured to plate P or to a fixed point relative thereto, by at least one, preferably at least two points of attachment 7, by screws, pins or suchlike. Strip spring 1 preferably extends in a parallel plane to that of barrel ratchet 2 and includes, in the median part thereof, a resilient arm 8 capable of bending under the action of the mainspring unwinding torque as will be explained in detail below. Click support 12 which carries click pivot pin 10, is formed by resilient arm 8 or is secured thereto. Preferably, support 12 constitutes the second end of strip spring 1 which is opposite points of attachment 7.

Preferably in proximity to this second end of resilient arm 8, opposite the first end for attachment to the plate, the dynamometric device includes a hand 6 devised to be able to display the barrel torque reserve, in cooperation with a graphic or graduated display or scale which forms a barrel torque reserve indicator 5.

Preferably, the elastic arm 8 is substantially radial relative to the axis of revolution of barrel ratchet 2, the second end thereof being directed outwards.

To display simply the preferential ranges for proper operation of the timepiece to the user, indicator hand 6 can move before torque reserve indicator 5, which includes a graphic or graduated scale on said plate or a bar fixed thereto, and which displays in succession the torque available at the barrel output as the mainspring unwinds, here between two marks 50 and 51.

To simplify the mechanism further, the flat ratchet click spring 4 is secured, at the first stationary end 11 thereof, to a support which is formed by support 12 of ratchet click 3.

Preferably, a strip spring 1 is in a single piece and incorporates resilient arm 8 and click support 12.

Resilient arm 8 is mobile between a winding position where the resistant torque that it exerts on the ratchet is equal to the maximum torque exerted by the completely wound mainspring, and an unwinding position which is its position of equilibrium where it exerts zero torque on said ratchet and where the mainspring is totally unwound. This arm 8 is thus flexible between these two positions; the stiffness of the arm can vary so as to display the available torque on a larger or smaller scale.

Preferably, resilient arm 8 is fixed to a bridge integral with a plate about a fixed point located in proximity to the arbour of barrel ratchet 2, and is deformed in a parallel plane to that of barrel ratchet 2, under the action of torque exerted by said mainspring.

Figure 2:
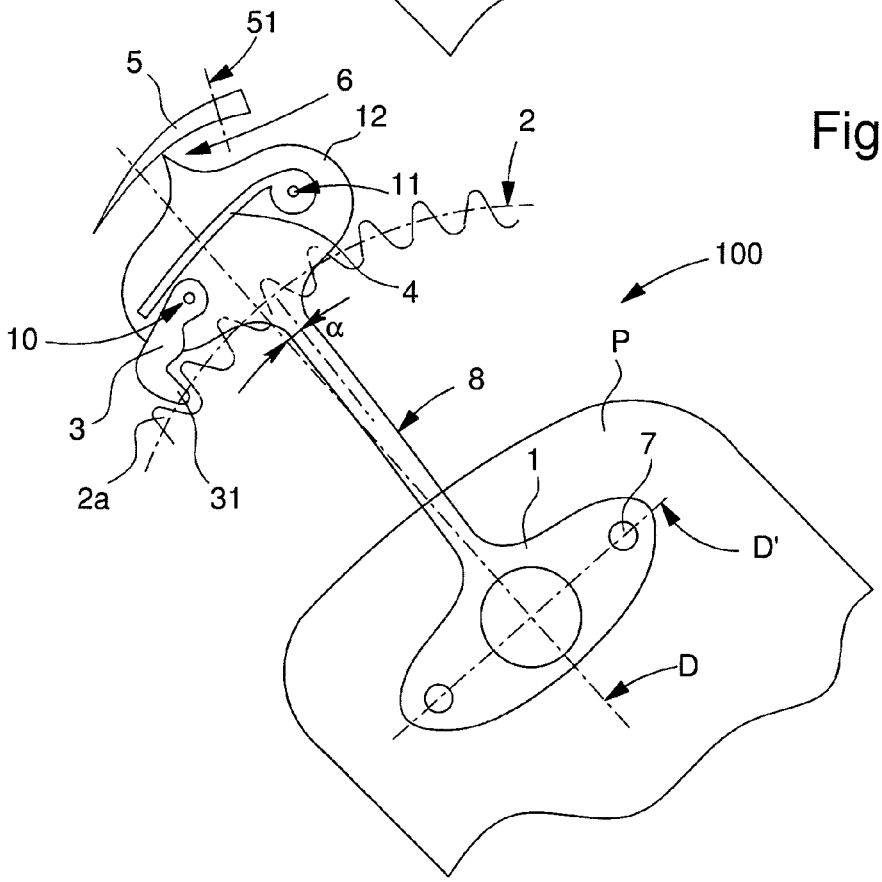
FIG. 2 shows, in a similar manner to FIG. 1, the same device in an intermediate winding position.
Figure 3:
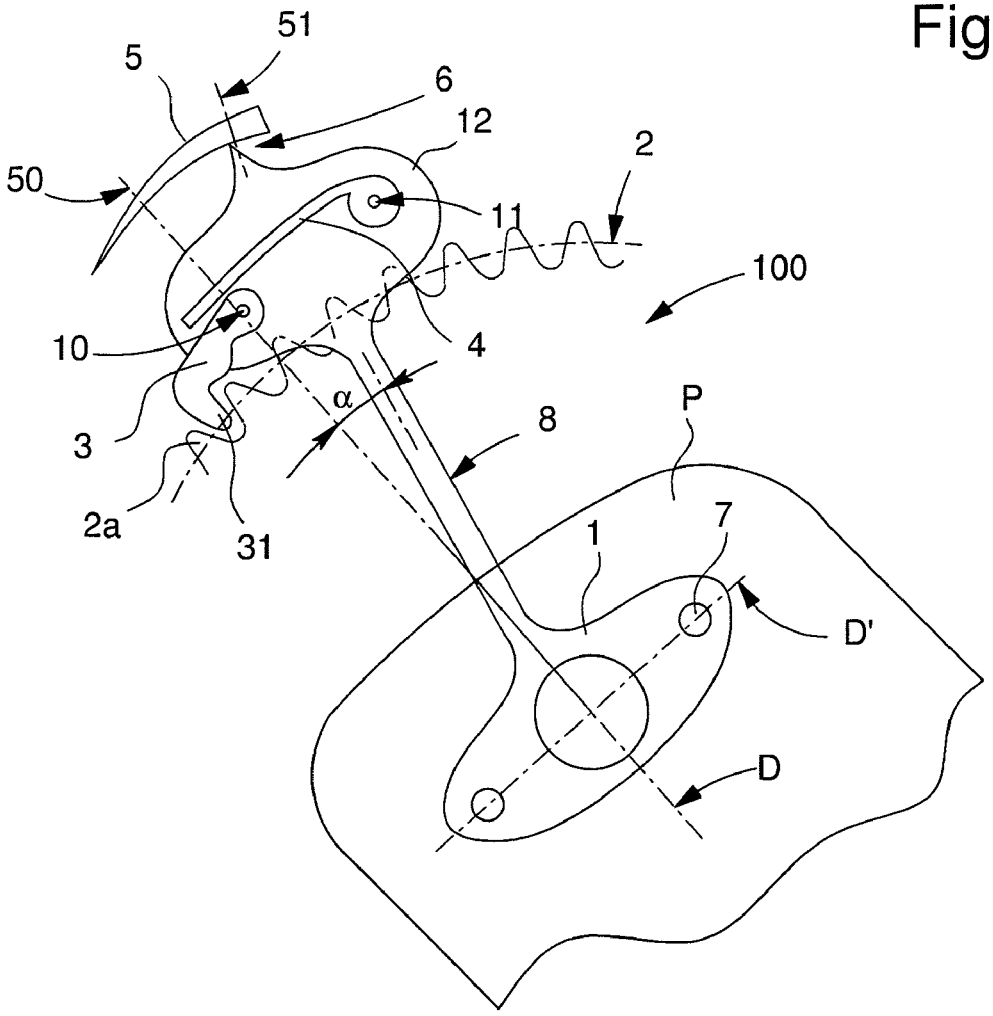
FIG. 3 shows, in a similar manner to FIG. 1, the same device in a maximum winding position.

The mainspring is wound in the direction of arrow A, as is seen in the Figures, namely in the anticlockwise direction. It is clear that, the more the mainspring is wound, the more torque there is in barrel ratchet 2. This torque is exerted, during rotation of barrel ratchet 2, in the clockwise direction in the case shown in the Figures, on toothing 31 of ratchet click 3. The latter may include only one tooth 31, and remain very economical, unlike numerous power reserve indication systems where the click is a complex part, including at least one toothed sector, and is much more expensive. The higher the torque exerted on tooth 31 of ratchet click 3, the more strip spring 1, and in particular resilient arm 8 which is the thinnest and most deformable part thereof, bends under the effect of the torque. An approximate diagram, in FIGS. 2 and 3, likens this bending to an angular deviation, of angle $\alpha$, of resilient arm 8, relative to a position of equilibrium embodied by a radial direction D. Points of attachment 7 extend preferably in another orthogonal direction D' to direction D. In fact, it is clear that the bending of strip spring 1, which occurs in the clockwise direction in the case shown, is distributed over its length. The effect of the bending is a movement of hand 6 relative to torque reserve indicator 5.

The Figures illustrate a preferred example in which the position of equilibrium of strip spring 1 is the unwinding position, and where all the other positions of strip spring 1 are wound positions.

It is clear that the torque reserve indication is thus given in dynamometric reference to a flat spring, which is extremely robust, inexpensive and compact, and that the dynamometric device 100 according to the invention does not depend in any way on the winding mode, whether winding occurs via a winding crown or an automatic winding rotor.

What is claimed is:

1. A dynamometric device indicating the remaining barrel torque in a timepiece, which includes a plate, a barrel and a barrel ratchet arranged for cooperating with a ratchet click to keep, in a spring located inside said barrel, the mechanical energy stored by the latter, said ratchet click being able to pivot about a click pivot pin, between a meshed position wherein at least one tooth of said ratchet click cooperates with said barrel ratchet, and a disengaged position wherein each tooth of said ratchet click withdraws when the barrel ratchet rotates, as said barrel is being wound, said ratchet click being returned towards said barrel ratchet under the action of a ratchet click spring, said device being wherein it includes a strip spring including a resilient arm a first end of which is rigidly secured to said plate or to a fixed point relative thereto, wherein said click pivot pin is mounted on a click support, which is formed by said resilient arm or fixed thereto, and wherein said device includes, in proximity to a second end of said resilient arm opposite to said first end, an indicator member for displaying the barrel torque reserve, in conjunction with a graphic or graduated scale.

2. The device according to claim 1, wherein said resilient arm is substantially radial relative to the axis of revolution of said barrel ratchet.

3. The device according to claim 1, wherein said click support includes, opposite said resilient arm, an indicator hand forming the mobile indicator member in front of a graphic or graduated scale on said plate or a bridge secured thereto, and which displays the torque available at the barrel output.

4. The device according to claim 1, wherein said ratchet click spring is secured, at an end opposite to the end resting on said ratchet click, to said click support.

5. The device according to claim 1 wherein said strip spring is in a single piece and incorporates said resilient arm and said click support.

6. The device according to claim 1, wherein said resilient arm is mobile between a winding position where the resistant torque said arm exerts on said barrel ratchet is equal to the maximum torque exerted by said mainspring when completely wound, and an unwinding position which is the position of equilibrium thereof where said arm exerts zero torque on said barrel ratchet and where said mainspring is totally unwound.

7. The device according to claim 1, wherein said resilient arm is secured to a bridge integral with said plate about a fixed point located in proximity to the arbour of said barrel ratchet, and is deformed in a parallel plane to that of said barrel ratchet under the action of torque exerted by said mainspring.

8. The device according to claim 1, wherein said ratchet click includes a single tooth.

* * * * *